US005897441A

United States Patent [19]

Apthorp

[11] Patent Number: 5,897,441

[45] Date of Patent: Apr. 27, 1999

[54] GOLF SWING PRACTICE DEVICE

[75] Inventor: Mark S. Apthorp, London, Canada

[73] Assignee: GSP Co. Inc., Canada

[21] Appl. No.: 09/084,974

[22] Filed: May 28, 1998

[51] Int. Cl.[6] ..... A63B 69/36

[52] U.S. Cl. ..... 473/220; 473/409

[58] Field of Search ..... 473/220, 409

[56] References Cited

U.S. PATENT DOCUMENTS

| | | | |
|---|---|---|---|
| 4,858,934 | 8/1989 | Ladick et al. | 473/220 |
| 4,971,327 | 11/1990 | Rabold . | |
| 5,161,802 | 11/1992 | Daechsel . | |
| 5,165,691 | 11/1992 | Cook . | |
| 5,169,150 | 12/1992 | Tindale . | |
| 5,207,429 | 5/1993 | Walmsley et al. . | |
| 5,330,188 | 7/1994 | Reimers . | |
| 5,467,991 | 11/1995 | White, IV et al. . | |
| 5,470,072 | 11/1995 | Cunningham . | |
| 5,472,204 | 12/1995 | English et al. . | |
| 5,788,582 | 8/1998 | Shapiro | 473/220 |
| 5,810,674 | 9/1998 | Falossi et al. | 473/220 |

*Primary Examiner*—George J. Marlo

*Attorney, Agent, or Firm*—Trevor C. Klotz

[57] ABSTRACT

A golf swing practice device is disclosed and which comprises a carrier member which is removably attached to the shaft of a golf club and which is preferably attached to a lower portion of the hand grip on the golf club. Two spaced apart light sources are mounted on the carrier so as to emit two discrete and parallel beams of light which extend in a direction towards the head of the club and which lie in a plane which bisects a face of the club head and which is also substantially perpendicular to the club face. The light tracings on the ground from the two beams of light on the ground and relevant to a target line which is also on the ground, inform the golfer if the practice golf swing relative to an imaginary golf ball is on or off line, square to the ball or being hit in a toe-in or toe-out condition. In an additional embodiment, the carrier member can also be attached to a hole in the hand grip located at the proximal end of the golf club so as to support at this end a third light source the beam of which is coaxial with the shaft of the club and which extends in a direction opposite to the beam direction of the light sources on the carrier member. The ground tracing produced by this third beam can be used to inform a golfer of the swing plane of the club shaft.

10 Claims, 4 Drawing Sheets

GOLF SWING PRACTICE DEVICE

This invention relates to a golf swing practice device which can be removably attached to a conventional left or right handed golf club and which enables a golfer who is practising a golf swing, to visually determine if the club face of the club head of a golf club is square to the ball at the point of ball contact. The device can also be advantageously employed in visually communicating to a golfer the plane in which the golf club is located during the latter portion of the golfer's back swing, the initial stage of the down stroke and the follow through.

BACKGROUND OF INVENTION

The use of light sources, light reflectors and light beams which are either built into a golf club or attached to a golf club, usually along the shaft of the club, are well known in the art and most commonly are employed for visually informing a golfer if the impact face of the club head is square to the target line at the point of actual or imagined golf ball impact.

One such attachment device is disclosed in U.S. Pat. No. 5,467,991 issued Nov. 21, 1995, White, which discloses a base mounting plate which is removably attached to a club shaft and which supports a pair of light emitting diodes (LED's) aimed in opposite directions parallel to the shaft of the club.

As the beam of light emitted from the lowermost LED is offset relative to the axis of the club shaft, the light trace which the beam makes when it impinges the ground is behind the head of the club head. Because of this offset, the light trace on the ground is not representative of the actual location of the impact face of the club head, and further, does not produce a straight line ground light trace in the ball impact area due to the rotation of the hands and club in this area.

The second LED on the White device also emits a beam of light which is offset and parallel to the axis of the shaft, but which in this instance extends in a direction opposite to the first or lowermost beam. This second or upper beam, during the latter part of the back swing, early part of the down swing and during follow through is intended to produce a light trace on the ground which is parallel to the desired target line. While White's golf swing training device is useful in assisting a golfer in determining if the golfer's swing is following the correct swing plane by the two light tracings on the ground, it is not possible through the use of the single and offset downwardly projecting light beam to determine if the face of the club head at the point of actual or imaginary ball impact is on line to the ball, "square" to the ball or if it is open or closed to the ball and which is commonly described as a toe-in or toe-out condition. Toe-in or toe-out of the face of a club head normally imparts to an impacted ball unwanted side spin which results in either a hook or slice.

Cunningham in U.S. Pat. No. 5,470,072 issued Nov. 28, 1995, provides for two spaced apart light sources positioned on the crown or top surface of a club head and which are also positioned in a plane perpendicular to the ball impact face of the club head. If the light tracings from the light sources (which are directed or reflected towards the golfer swinging the club and not the ground) appear superimposed at the point of actual or imaginary ball impact, it indicates to the person swinging the golf club that the face of the club head is square to the ball. However, if the two light tracings in the proximity of ball impact are offset one relative to the other, it is indicative that the club face is not square, and is either in a toe-in or toe-out condition.

Cunningham also discloses the attachment of a bar to a lower portion of the shaft of the club with the bar carrying light sources or light reflectors thereon, and which provides the golfer with the same interpretive information as given when the light sources are positioned on the crown of the golf head.

While Cunningham assists one in determining if the club face is square to the ball at the point of impact, no interpretive visual information is given the golfer about the golfer's swing being in the correct swing plane or if the imaginary ball which appears to be hit square, is in fact being hit square but in a in-to-out or an out-to-in swing arc relative to the desired target line; thereby creating what is termed a "push" or a "pull".

SUMMARY OF THE INVENTION

In accordance with my invention, I have devised a golf swing practice device which can be removably attached to the shaft or preferably to a hand grip on the shaft of conventional golf woods or irons and which enables a golfer, through light tracings on the ground, to determine if the face of the club head is square at the time of imaginary ball impact and also if the golfer's swing plane is correct relative to the desired target line. As discussed above, neither of the light tracings generated by the White or Cunningham practice devices, provide this type of interpretive information.

In order to achieve the foregoing, and in accordance with one embodiment of my invention, the practice device comprises a carrier member which can be removably attached to a shaft of a golf clubs and which is preferably attached to the lower portion of the hand grip which is itself mounted on the free end of the shaft. First and second light sources, preferably lasers, are mounted on the carrier and so positioned thereon to emit therefrom two spaced apart and parallel discrete beams of light in a direction towards the head of the club. The two light sources on the carrier are located on either side of the shaft when the carrier is attached to the shaft or grip, and are so positioned that the two light beams emitted therefrom together lie in a plane which bisects a club face of the club head at a right angle.

When using the practice device of my invention, one and preferably two spaced apart parallel lines on the ground, which represent the desired target line a hit ball should follow, can usefully be employed in interpreting the two light beam traces which appear on the ground during a golf swing. In this regard, I prefer to use with the practice device of my invention a "runway" formed from an elongate strip of any suitable material which can be placed on the ground and which has extending along the upper surface thereof, two spaced apart and parallel lines which represent the desired target line and which also includes a control marking which represents the location of an imaginary ball which is to be hit.

Based on these two light tracings during the latter portion of the down swing and early portion of the up swing, a golfer practising his or her swing can determine if the golf head is square at the point of imaginary ball impact or if it is being hit in a toe-in or toe-out condition. Using the same tracings, relative to the two spaced apart and parallel lines on the ground or the runway, it can also be visually determined if the golfer's swing plane is, at the point of imaginary ball impact, on line or if the club path is going from in-to-out or out-to-in.

Due to mounting considerations, the carrier member preferably surrounds at least one half of the circumference of the club shaft to which it is attached. This may be in the form of a C-shaped section and two opposed and spaced apart limbs which respectively extend inwardly from the free ends of the C-shaped section towards the shaft. Using this arrangement, the spacing between these limbs which preferably attach the carrier member to the lower portion of the club grip, can be made adjustable so as to facilitate its attachment and removal. Further, the two light sources can be advantageously located proximate the ends of the C-shaped section.

In accordance with yet another aspect of my invention, the carrier member, in addition to being removably attached to the hand grip or shaft of the golf club shaft, can also be connected to the free or proximal end of the shaft by elongate second connection means which connects the carrier member to a hole which is invariably located in the free end of the hand grip attached to the shaft. This second connector means can also advantageously act as a mount for a third light source which is located on it at its end which attaches to the hole in the grip, so as to emit a beam of light in a direction substantially coaxial with the axis of a shaft but in a direction away from the club head, and in a manner not unlike the second LED light source disclosed in the above referenced patent of White. However, and unlike White, because the beam of light emitted from my third light source is coaxial with the axis of the shaft of the golf club when it traces a line on the ground (during the latter portion of the back swing and early portion of the down swing and follow through), it is representative of the true plane in which the shaft of the club is located.

Using the same spaced apart and parallel lines on the ground or on a runway as previously described and which represent the desired target lines the ground tracing from the third beam of light should ideally move between and also be parallel to the two parallel target lines.

DESCRIPTION OF DRAWINGS

In the accompanying drawings which illustrate various embodiments of my invention and how the light tracings on the ground can be used for interpretive purposes.

DETAILED DESCRIPTION OF DRAWINGS

Figure 1:
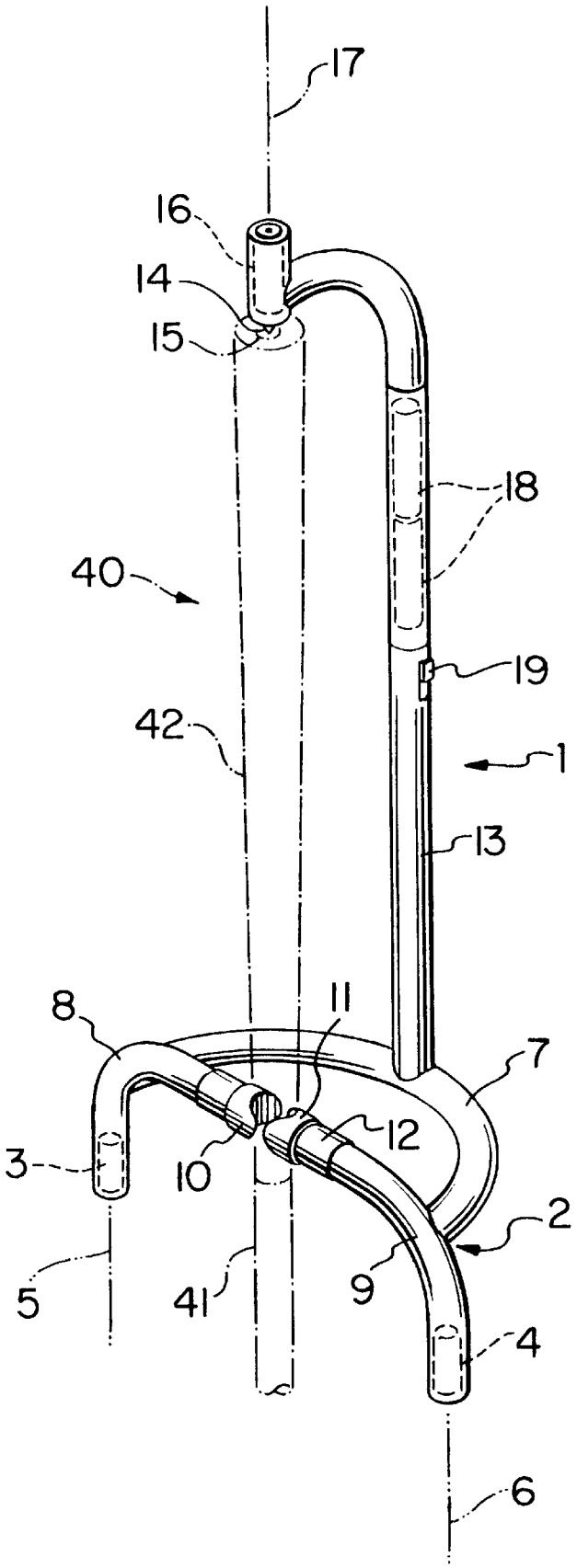
FIG. 1 is a perspective view of the practice device and the positioning of the three light sources when the device is attached at two locations to a hand grip of a golf club.

The golf swing practice device 1 shown in FIG. 1 is illustrated relative to its mounting location on the hand grip 42 of golf club 40; the golf club 40, golf club shaft 41 and hand grip 42 being shown in broken line.

In accordance with a first embodiment of my invention, the practice device consists of a carrier member 2 having two spaced apart light sources mounted thereon and which are also illustrated in broken line at 3 and 4, and which respectively direct parallel beams of light indicated by lines 5 and 6 towards the distal end of shaft 41.

Figure 2:
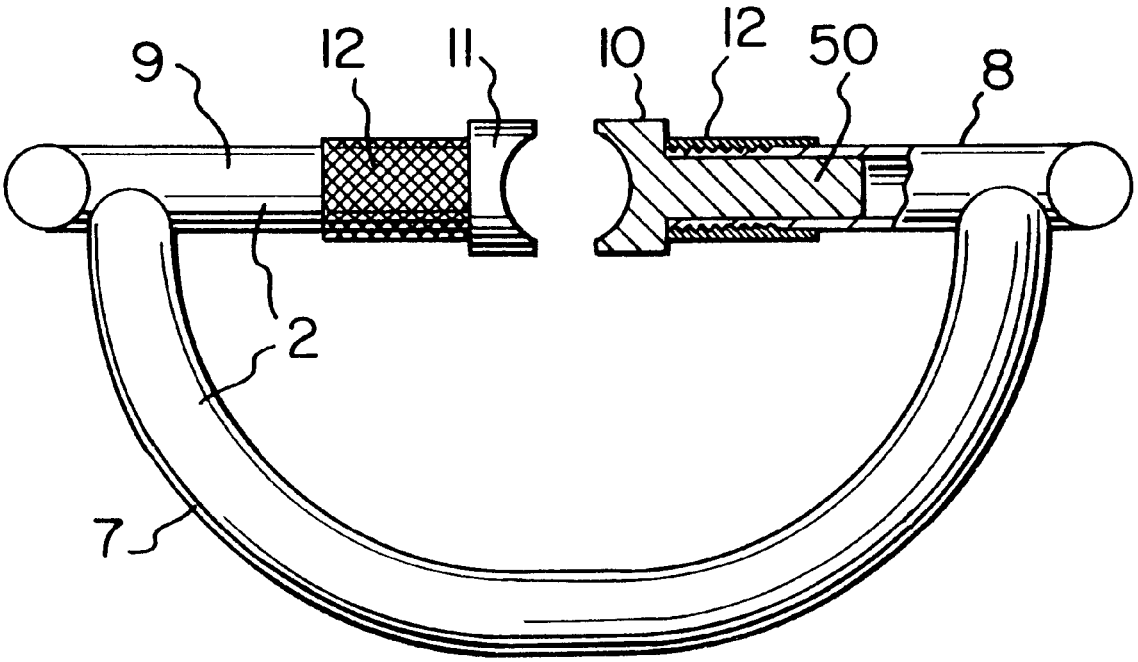
FIG. 2 is a top plan view of the carrier member shown in FIG. 1 and which includes a cut away view of one of the clasping elements.

As illustrated in FIGS. 1 and 2, carrier member 2 is made up from a C-shaped section 7 and limb elements 8 and 9 which are each respectively attached to a free end of C-shaped section 7. The opposed and inwardly directed limbs of elements 8 and 9 at their respective free ends are provided with curved clasping elements 10 and 11 which serve to removably attach carrier member 7 to shaft 4. The spatial distance between the clasping elements can be varied so that the carrier can be readily attached and removed from hand grip 42. To this end, curved clasping element 11 can remain fixed to the limb of element 8 while clasping element 10 is permitted to move inwardly and outwardly by simply rotating tubular sleeve 12 which is threadedly connected to element 8 in a manner which is well understood in the art.

As illustrated, limbs 8 and 9 at the end of C-shaped section 7 also each extend downwardly and have internally located therein, light sources 3 and 4 illustrated in broken line which emit discrete beams of light depicted by lines 5 and 6. Any suitable sources of light can be employed, such as light emitting diodes (LED's) or lasers provided they emit sufficiently strong discrete beams of light to illuminate the ground. I prefer to use lasers as my light sources and have found laser diodes which have a wave length of 635–688 mm and maximum output of 5 mW, such as those used in known laser pointers used for instructional purposes, to be ideally suited since the visual beam is red and is not affected by ambient light.

In accordance with a second and more preferred embodiment of my invention, the above described carrier member which can be removably attached to one location at the hand grip or shaft employing suitable connector means such as opposed clasping elements 10 and 11, can also be attached to the upper or proximal end of the golf club employing a second elongate connector 13 which at one end is fixed to carrier member 2 as shown in FIG. 1 and which at its other end, terminates at projecting pin 14 which can be inserted in a hole 15 which is located in the top end of the hand grip 42 as illustrated. Connector 13 along its major length is spaced from grip 42 a sufficient distance to enable the clasping of hand grip 42 without interference.

Advantageously second connector 13 at its end which attaches to grip 42 can also be used to support a third light source 16 which is oriented so as to direct a discrete beam of light in a direction opposite to parallel light beams 5 and 6 and which is coaxial with shaft 41.

As shown, the power supply for light sources 3, 4 and 16 can comprise battery power with two such batteries being illustrated in series and located internally of the second connector 13 as illustrated in broken line at 18. Switch 19 is used to turn the power supply for the light sources on and off in a well known manner.

While not shown, it will be apparent that if the golf swing device is used without the above described second connector 13 and its accompanying third light source 16, the power supply for the light sources 3 and 4 in carrier member 2 can be located internally of section 7.

Figure 3:
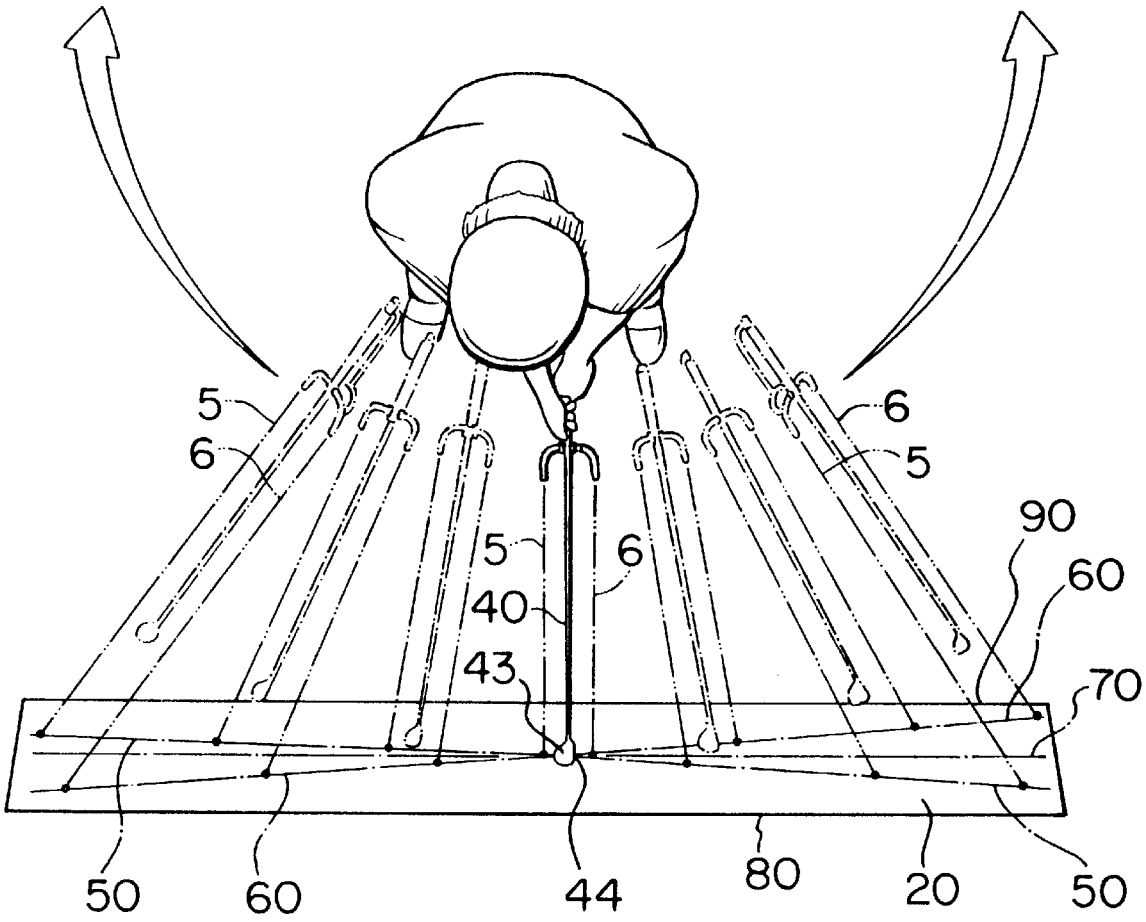
FIG. 3 is an illustrative top schematic view showing the ground line tracings produced by the two light sources on the carrier member at various stages of a golf swing.
Figure 4:
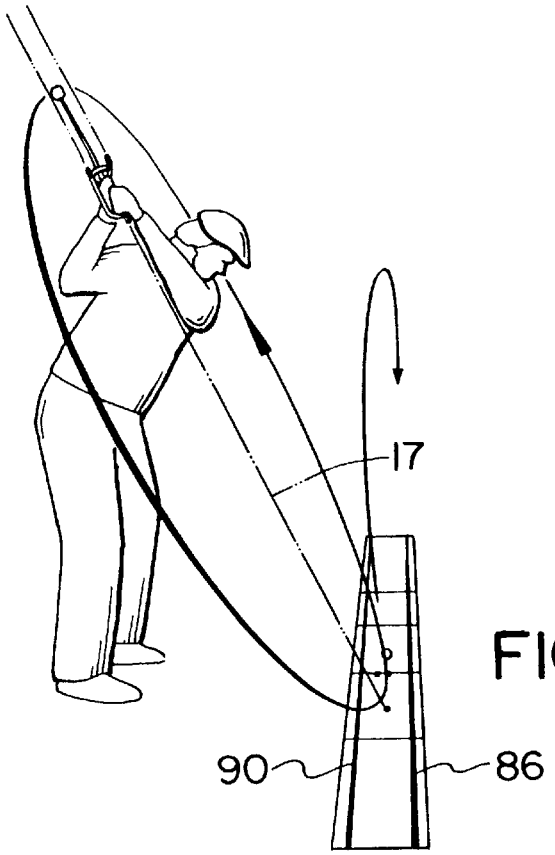
FIG. 4 is a rear illustrative view of a golfer's swing arc and the ground tracing of the third light beam relative to the desired target line.
Figure 5:
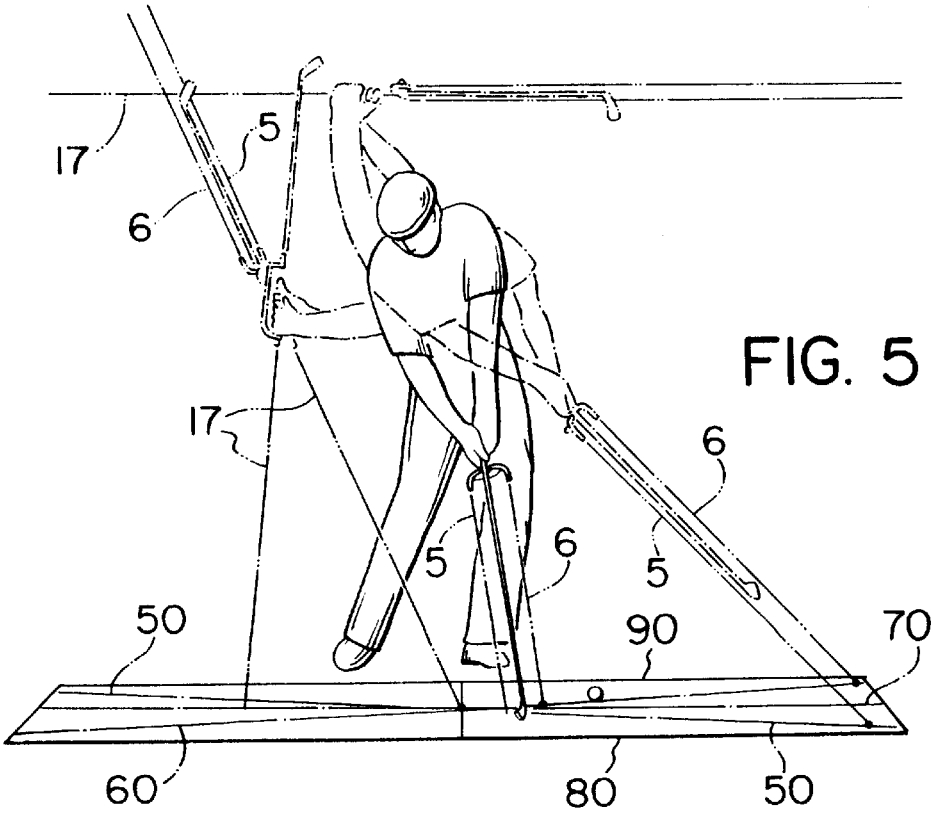
FIG. 5 is a illustrative side view showing the various ground tracings produced by the three light sources at various stages during a golf swing.

Referring now to FIGS. 3, 4 and 5, the ground tracking of the parallel beams of light 5 and 6 emitted from light sources 3 and 4 of carrier 7 during a golf swing is best depicted in FIG. 3, while the inter-relationship of these ground tracings with the ground tracing produced by light beam 17 from the third light source 16 is best portrayed with reference to FIG. 5.

With particular reference to FIG. 3, the ground tracings of light beams 5 and 6 is depicted on a thin practice strip or runway such as a length of plastic sheet material 20 or the like having parallel sides 80 and 90 or equivalent spaced apart parallel markings thereon (not shown), and which can be orientated so as to represent the desired target line. Line 70 as illustrated is parallel to sides 80 and 90 and represents the line an which the imaginary ball (not shown) will be located for practice purposes. I prefer not to imprint line 70 on practice strip 20, but rather, to mark a spot along this imaginary line immediately in front of face 44 of club head 43.

Chain-line 50 represents the light tracing produced by beam 5, and chain-line 60 represents the line tracing produced by beam 6 and which are the light tracings which are produced during an optimum golf swing when an imaginary golf ball is impacted square and on line to the target by club face 44.

It will be seen that these tracings at the point of imaginary ball impact cross over one another in the form of an "X" and which to the golfer using the practice device, is visually apparent. If the cross over of the two ground tracings from light beams 5 and 6 appear to the golfer to occur prior to the desired point of impact, this represents to the golfer that the imaginary ball has been hit in a toe-in condition and remedial practice adjustment is required. Conversely, if the "X" is seen to cross over after the point of imaginary impact, it serves to indicate the impact face 44 of the club 40 is open or in a toe-out condition.

Beam 17 emitted from the third light source 16 and its interplay relative to parallel target lines 80 and 90 and the swing plane through which the golf club 40 should ideally follow is graphically depicted in FIGS. 4 and 5, where beam 17 during the latter stages of the back stroke and early stages of the down stroke should trace a line on the ground or runway between parallel lines 80 and 90 and ideally, along center line 70.

While I have shown a preferred form of construction of my golf practice device in context of there being two separate means for attaching it to a golf club at two different locations, as pointed out above, the carrier member need only be releasably secured to the grip at one location if the practice device is only to be used with the two light sources on the carrier member. Further, it will also be appreciated that while I have advanced a particular form of construction which is intended to achieve the end objects of my invention, various alterations and changes can be made to it which do not depart from the spirit or scope of my invention.

I claim:

1. A golf swing practice device for use with a golf club having a club head and a club shaft, comprising:

(a) a carrier member;

(b) first and second light sources mounted on said carrier member for emitting in a direction towards said club head two spaced apart and parallel discrete beams of light; and (c) connector means on said carrier member for removably attaching said carrier member to one of said shaft and a hand grip on said shaft and at a location intermediate said first and second light sources so that the discrete beams of light emitted therefrom together lie in a plane which bisects a club face of said club head and which is substantially perpendicular to said club face.

2. The golf swing practice device as claimed in claim 1, wherein said carrier member is attached to a lower portion of said hand grip on said shaft and further includes a support section which surrounds at least one half of the circumference of said shaft.

3. The golf swing practice device as claimed in claim 2, wherein said support section includes a C-shaped section and two opposed and spaced apart limbs which respectively extend inwardly towards said shaft from the ends of said C-shaped section.

4. The golf swing practice device as claimed in claim 3, wherein at least one of said limbs includes means for adjusting the spacing between said limbs.

5. The golf swing practice device as claimed in claim 4, wherein said first and second light sources are respectively located proximate the ends of said C-shaped section.

6. The golf swing practice device as claimed in claim 2, which further includes second connector means for removably securing said carrier member to a hole located in the free end of said hand grip.

7. The golf swing practice device as claimed in claim 6, wherein said second connector means is elongate and at its end proximate said hole means includes a third light source for emitting a third beam of light in a direction substantially co-axial with the axis of said shaft in a direction away from said club head.

8. The golf swing practice device as claimed in claim 7, wherein the other end of said elongate second connector means is attached to said carrier member and which between its said ends, includes an intermediate portion which extends substantially parallel to and spaced apart from said hand grip to thereby permit said hand grip to be hand grasped.

9. The golf swing practice device as claimed in claim 1, wherein said light sources are solid state lasers.

10. The golf swing practice device as claimed in claim 1, in combination with a thin elongate strip for placement on the ground and which on the upper face thereof includes two spaced apart and parallel lines which represent the desired target line of a golf ball and a central marking therebetween which represents a placement location for a golf ball positioned thereon.

* * * * *